United States Patent [19]

Arroyo et al.

[11] Patent Number: 5,059,217

[45] Date of Patent: Oct. 22, 1991

[54] FLUID TREATING DEVICE

[76] Inventors: Melvin L. Arroyo, 320 Madison St., Gretna, La. 70053; Leonard Cannizaro, 540 Olive Ave., Harvey, La. 70058

[21] Appl. No.: 594,990

[22] Filed: Oct. 10, 1990

[51] Int. Cl.[5] ..... C10L 5/00

[52] U.S. Cl. ..... 44/639; 123/1 A

[58] Field of Search ..... 44/639; 123/1 A

[56] References Cited

U.S. PATENT DOCUMENTS

| | | | |
|---|---|---|---|
| 2,955,028 | 10/1960 | Bevans | 44/639 |
| 3,448,034 | 6/1969 | Craft | 204/148 |
| 3,486,999 | 12/1969 | Craft | 137/240 |
| 4,429,665 | 2/1984 | Brown | 123/1 A |
| 4,547,356 | 10/1985 | Papineau | 123/1 A |
| 4,715,325 | 12/1987 | Walker | 123/1 A |

*Primary Examiner*—Prince E. Willis
*Assistant Examiner*—R. D. Flatter
*Attorney, Agent, or Firm*—Keaty & Keaty

[57] ABSTRACT

The invention relates to a fluid treating device for treatment of gasoline or diesel fuel for land and/or water vehicles. The liquid fuel treating device has an elongated housing provided with liquid fuel lines on opposite ends thereof. A central opening in the housing houses a metal bar which is formed with an alloy, the metal composition including copper, nickel, zinc, tin, magnesium and silicon. The liquid fuel is forced through the liquid fuel line into the housing, wherein it contracts the metal bar and exits through a second liquid fuel line as a treated liquid fuel with improved characteristics, substantially free of pollutants.

16 Claims, 1 Drawing Sheet

FLUID TREATING DEVICE

BACKGROUND OF THE INVENTION

The present invention relates to a device for treating liquid fuels, such as hydrocarbon fuels used by land and water vehicles with internal combustion engines.

It has been and increasing concern to the industry to improve efficiency of vehicles, so as to use less gasoline and diesel fuel and, at the same time, reduce harmful emissions created by internal combustion engines which are emitted into the atmosphere.

Some of the devices and methods utilized for such purposes include catalytic converters, addition of various chemicals into the fuel and the like.

However, the problem still remains of making the internal combustion engines of vehicles to work more efficiently, still further eliminating pollutants in exhaust emission.

One of the examples utilized for treatment of fuels is disclosed in U.S. Pat. No. 4,429,665 issued on Feb. 7, 1984 to Bill H. Brown and entitled "Fuel Treating Device and Method". The device disclosed in '665 patent comprises a hollow casing within which a metal bar is located. The fuel is forced to flow through the casing, contacting the metal bar, which is formed from an alloy of nickel, zinc, copper, tin and silver, thereby producing improved combustion characteristics in the fuel passing through the housing.

The present invention contemplates provision of a less expensive, easier to manufacture device, which possesses better fuel efficiency characteristics than is currently known in the art and which can be used in various vehicles, both land and water, propelled by gasoline or diesel fuel.

SUMMARY OF THE INVENTION

The present invention contemplates elimination of drawbacks associated with the prior art and provision of an improved liquid fuel treating device which is inexpensive and easy to manufacture and which provides improved liquid fuel treatment results.

The device of the present invention comprises an elongated housing having a central opening extending therethrough. A pair of liquid fuel line means extend outwardly from opposite ends of the housing, each liquid fuel line means having an axial passageway which is in liquid fuel communication with the central opening of the housing. One end of the central opening formed in the housing is formed as a restricted diameter opening, so as to create venturi effect in the liquid fuel flow and allow better contact of the liquid fuel passing through the central opening to contact a metal bar which is positioned within the central opening. The metal bar comprises an alloy which comprises copper, nickel, zinc, tin, magnesium and silicon which, is believed, affects molecular structure of the liquid fuel passing through the central opening of the housing, eliminating pollutants present in the liquid fuel.

To facilitate assembly of the liquid fuel treating device, the housing and at least one of the liquid fuel line means are formed as an integral unit. The second liquid fuel line means is "snappingly" engaged with the opposite end of the housing through a provision of an outwardly extending circumferential ridge on a cylindrical member of the liquid fuel line means, the ridge being sized and shaped to fit within an annular groove formed in the interior wall of the housing adjacent the second end of the housing. An increased diameter shoulder formed in the second liquid fuel line means prevents further movement of the liquid fuel line means into the central opening by abutting the second end of the housing.

The metal bar has a hub of substantially square cross section and four narrow ridges, each extending from a corner of the hub substantially through the entire length of the metal bar.

The liquid fuel line means which fits within the housing is also preferably formed with a restricted diameter portion of the liquid fuel passageway, so as to create a second venturi effect and to allow better contact of the liquid fuel with the metal bar positioned in the housing.

It is therefore an object of the present invention to provide a liquid fuel treating device having improved characteristics of the treated liquid fuel.

It is a further object of the present invention to provide a liquid fuel treatment device which is inexpensive and easy to manufacture and assemble.

It is still a further object of the present invention to provide a liquid fuel treating device which can be used with internal combustion engines fueled by gasoline and diesel.

These and other objects of the present invention will be more apparent to those skilled in the art from the following detailed description of the invention.

BRIEF DESCRIPTION OF THE DRAWING

Reference will now be made to the drawings, wherein like parts are designated by like numerals, and wherein.

DETAILED DESCRIPTION OF THE PREFERRED EMBODIMENT

Figure 1:
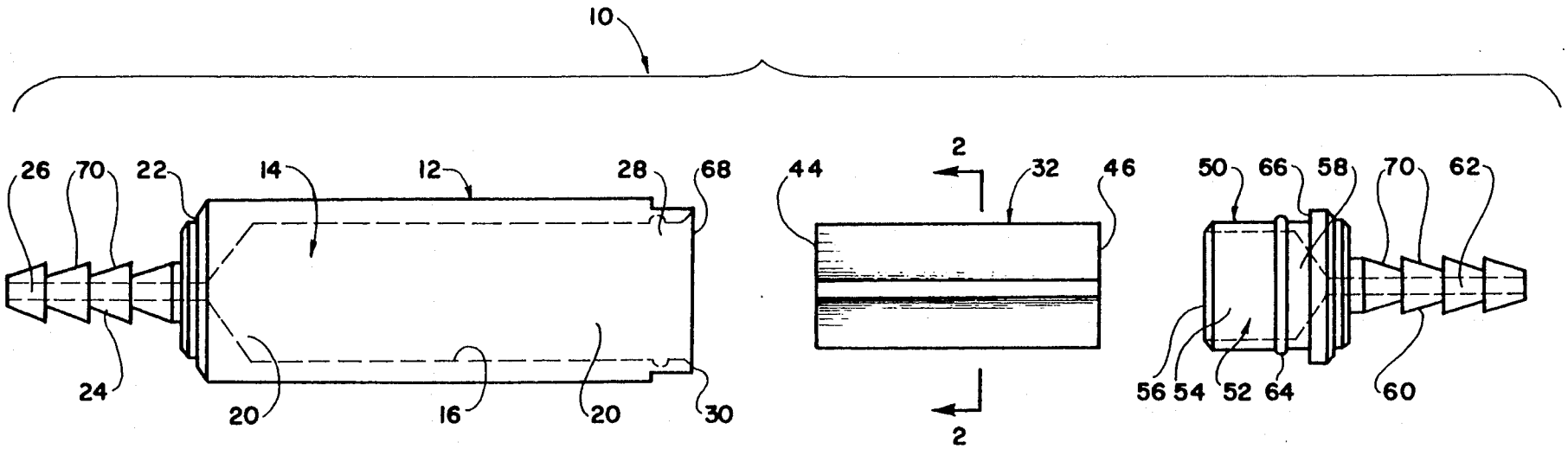
FIG. 1 is an exploded plan view of the device in accordance with the present invention.
Figure 2:
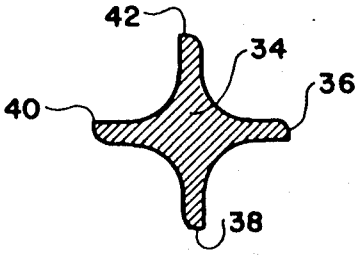
FIG. 2 is a cross sectional view taken along lines 2—2 in FIG. 1.

Referring now to the drawings in more detail, the preferred embodiment of the device of the present invention is seen generally designated by numeral 10. The device 10 comprises a housing 12 having a central chamber 14 formed therein. The chamber 14 is formed by an internal wall 16 of the housing 12 and has a generally cylindrical portion 18 and a reduced diameter generally conically-shaped portion 20.

Fixedly attached to one end 22 of the housing 12 is a liquid fuel line 24 which is formed with a central opening 26 extending therethrough. The central opening 24 is in liquid fuel communication with the chamber 14 of the housing 12 and serves as an outlet liquid fuel line for the device 10.

An annular groove 28 is formed in the inner wall 16 of the housing 12 adjacent a second end 30 of the housing. The wall 16 is angularly outwardly flared adjacent the end 30, the reasons for which will be explained in more detail hereinafter.

Adapted for mounting within the chamber 14 is a metal member 32 which is formed as an elongated bar having a central hub 34 with four outwardly projecting ribs 36, 38, 40 and 42. The distance between the exteriormost surfaces of the ribs 38 and 42 is equal to the distance between the exteriormost surfaces of the ribs 36 and 40. This same distance is slightly smaller than the diameter of the portion 20 of the chamber 14.

When the metal member 32 is positioned within the chamber 14, a plurality of liquid fuel passageways are formed by spaces between the ribs 36, 38, 40 and 42 and the central hub 34. The overall length of the metal member 32, between its ends 44 and 46 is smaller than the length of the chamber 14, so as to allow free flow of fuel through the chamber 14, but still forcing the fuel to contact the metal member 32. The metal member 32 is formed from an alloy comprising copper, nickel, zinc, tin, magnesium and silicon. It was determined that in preferred embodiments the percentage of elements by weight would be as follows:

Copper—40–50% by weight
Nickel—15–30% by weight
Zinc—10–20% by weight
Tin—5–20% by weight
Magnesium—1–15% by weight
Silicone—0.5–5% by weight In a still further preferred embodiment the copper would be present in the amount of 49% by total weight, nickel would be present in the amount of 22% by total weight, zinc would be present in the amount of 14% by total weight, tin would be present in the amount of 8% by total weight, magnesium would be present in the amount of 4% by total weight and silicon would be present in the amount of 2% by total weight.

For the reasons not as well yet understood, the composition of the above-listed metals considerably improves fuel efficiency of a vehicle, even in comparison with the device of '665 patent. It is thought, although not proven, that the molecular structure of gasoline molecules is rearranged by contact with the metals which destroys the pollutants or micro-organisms which might be still present in the fuel and adversely affect the car efficiency and the quality of emissions.

An inlet liquid fuel line plug member 50 has a central chamber 52 formed therein by a cylindrical portion 54 at the end 56 and a generally cylindrically shaped portion 58 adjacent an inlet liquid fuel line 60. The liquid fuel line 60 is formed with a central opening 62 therein which is in liquid fuel communication with the chamber 52 of the plug member 50 and, when the plug is inserted within the opening 20 of the housing 12, allows liquid fuel communication between the inlet line 62 and outlet line 26.

The member 50 is formed with an enlarged diameter annular ridge, or lip 64 which is adapted to snap into the groove 28 of the housing 12 when the plug member 50 is moved into engagement with the housing 12. The inwardly facing enlarged diameter annular shoulder 66 formed on the exterior of the cylindrical plug member 50 abuts the end 30 of the housing 12 and prevents further inward movement of the member 50 into the chamber 14.

It was found that the "snapping" engagement of the plug member 50 allows considerable saving in time and labor when the device 10 is assembled during manufacture. Instead of conventionally used threadable engagements, the snapping engagement allows for much faster and precise positioning of the member 50 in relation to the housing 12. The outwardly flared portion 68 of the housing 12 facilitates easy alignment of the member 50 in relation to the central opening or chamber 14 during assembly.

The reduced diameter portions 20 and 58 of the housing 12 and the plug member 50, respectively, create a venturi effect in the liquid fuel flow passing through the inlet line 62, into the opening 52 and through the chamber 14 into the outlet 26. The fuel is forced to move at an increased speed through the device 10 which allows better contact with the metal bar 32.

The liquid fuel lines 24 and 60 are formed with a plurality of frusto-conical sections 70 co-axially aligned with each other and attached in end-to-end fixed engagement with each other. It was found that during engagement with flexible fuel hoses conventionally found in vehicles, the members 70 allow better engagement with the interior walls of the flexible resilient hose creating a "barbing" effect when forced in the direction opposite the direction of their installation.

As can be seen in the drawings, the narrowest ends of the outermost conical members 70 face outwardly, allowing better and faster engagement of the liquid fuel lines 24 and 60 with the flexible hoses.

The housing 12, liquid fuel lines 24 and 60, as well as the plug member 50 can be made by injection molding, with the exterior wall of the housing 12 being formed as a cylinder or in the form of a polygon.

When the liquid fuel line 24 and 60 are inserted within the hoses of fuel injectors or other fuel lines, the exterior of the hose can be secured with a conventional clamp to prevent possible disengagement of the line 24 and 60 from the elastomeric hoses.

The material from which the housing 12 and the member 50 is formed can be selected from an electrically non-conductive material, such as plastic, for example, polytetrafluoroethylene, which serves as an insulator and as neutral material which does not come into contact with the fuel.

It was found that application of self hardening substance, such as glue, on the cylindrical exterior of the member 50, before engagement with the housing 12, facilitates leak-proof, liquid fuel tight fixed engagement of the member 50 with the housing 12.

It was demonstrated that the use of the device of the present invention with internal combustion engines allows for quicker starts of the engine, increased liquid fuel economy, reduction of carbon build up on engine parts and spark plugs, as well as reduction in exhaust emission pollutants.

Many changes and modifications can be made in the design of the present invention without departing from the spirit and scope thereof. We, therefore, pray that our rights to the present invention be limited only by the scope of the appended claims.

I claim:

1. A liquid fuel treating device, comprising:

an elongated housing means having a central opening extending therethrough;

a pair of liquid fuel line means fixedly attached to opposite ends of the housing, each liquid fuel line means having an axial passageway in liquid fuel communication with the central opening of the housing, said central opening having at least one reduced diameter portion formed at one end in the central opening adjacent a liquid fuel line means, so as to create a venturi effect in a liquid fuel flow; and an elongated metal bar positioned within said central opening of the housing said metal bar comprising an alloy comprising copper, nickel, zinc, tin, magnesium and silicon, said metal bar being sized and shaped to allow contact of the metal bar with the liquid fuel passing through the central opening.

2. The device of claim 1, wherein at least one of said liquid fuel line means is fittingly engaged within a second end of the housing and extends, at least in part, into the central opening of the housing.

3. The device of claim 2, wherein said housing has an interior wall provided with an annular groove adjacent a second end of the housing.

4. The device of claim 3, wherein said at least one liquid fuel line means comprises a substantially cylindrical member having an outwardly extending circumferential ridge sized and shaped to engage with said annular groove of the housing.

5. The device of claim 2, wherein the axial passageway of said at least one liquid fuel line means has a reduced diameter part, so as to create a venturi effect adjacent the second end of the housing central opening.

6. The device of claim 4, wherein said at least one liquid fuel line means comprises an enlarged diameter shoulder which abuts a second end of the housing, when the cylindrical member is fitted within the central opening of the housing.

7. The device of claim 1, wherein said metal bar comprises a central hub having a generally square cross section and a plurality of metal ridges, each extending outwardly from a corner of the hub substantially through the entire length of the metal bar.

8. The device of claim 1, wherein said alloy comprises 40–50% by weight of copper, 15–30% by weight of nickel, 10–20% by weight of zinc, 5–20% by weight of tin, 1–15% by weight of magnesium and 0.5–5% by weight of silicon.

9. The device of claim 1, wherein said alloy comprises 49% by weight of copper, 22% by weight of nickel, 14% by weight of zinc, 8% by weight of tin, 4% by weight of magnesium and 2% by weight of silicon.

10. A liquid fuel treating device, comprising:

an elongated housing means having a central opening extending therethrough, said housing means having an interior wall provided with an annular groove adjacent a first end thereof;

a pair of liquid line means fixedly attached to opposite ends of the housing means, each liquid fuel line means having an axial passageway in fluid communication with the central opening of the housing means, said central opening having at least one reduced diameter portion formed at one end of the central opening adjacent a liquid fuel line means, so as to create a venturi effect in a liquid fuel flow passing through the treating device; and an elongated metal bar positioned within said central opening of the housing, said metal bar comprising an alloy which comprises copper, nickel, zinc, tin, magnesium and silicon, said metal bar being sized and shaped to allow contact of the metal bar with the liquid fuel passing through the central opening of the housing means.

11. The device of claim 10, wherein at least one of said liquid fuel line means is fittingly engaged within a second end of the housing means and extends, at least in part, into the central opening of the housing means.

12. The device of claim 11, wherein said at least one liquid fuel line means comprises a substantially cylindrical member having an outwardly extending circumferential ridge sized and shaped to engage within said annular groove of the housing and an enlarged diameter annular shoulder which abuts the second end of the housing, when the cylindrical member is engaged within the central opening of the housing means.

13. The device of claim 11, wherein the axial passageway of said at least one liquid fuel line means has a reduced diameter part, so as to create a venturi effect in the liquid fuel flow adjacent the second end of the housing means.

14. The device of claim 10, wherein said metal bar comprises a central hub having a generally square cross section and a plurality of narrow ridges extending outwardly from a corner of the hub substantially through the entire length of the metal bar.

15. The device of claim 10, wherein said alloy comprises 40–50% by weight copper, 15–30% by weight nickel, 10–20% by weight zinc, 5–20% by weight tin, 1–15% by weight magnesium, 0.5–5% by weight silicon.

16. The device of claim 10, wherein said alloy comprises 49% by weight copper, 22% by weight nickel, 14% by weight zinc, 8% by weight tin, 4% by weight magnesium and 2% by weight silicon.

* * * * *

UNITED STATES PATENT AND TRADEMARK OFFICE

CERTIFICATE OF CORRECTION

PATENT NO. : 5,059,217

DATED : October 22, 1991

INVENTOR(S) : Melvin L. Arroyo and Leonard Cannizzaro

It is certified that error appears in the above-identified patent and that said Letters Patent is hereby corrected as shown below:

On the title Page, item [76] Inventors: should read as follows:

--Melvin L. Arroyo and Leonard Cannizzaro--.

Signed and Sealed this

Second Day of March, 1993

*Attest:*

STEPHEN G. KUNIN

*Attesting Officer*

*Acting Commissioner of Patents and Trademarks*